US005938288A

United States Patent [19]

Saint-Pierre et al.

[11] Patent Number: 5,938,288

[45] Date of Patent: Aug. 17, 1999

[54] AUTOMATIC CONTROL SYSTEM AND METHOD FOR A MACHINE USED FOR EXCAVATING DRIFTS, TUNNELS, STOPES, OR CAVERNS

[75] Inventors: Jacques Andre Saint-Pierre, Hanmer; Everett James Henderson, Whitefish; Jeffrey Nicholas Repski, Saskatoon; Guy Chevrette, St-Laurent, all of Canada; Peter Heinrich Hennecke, Zulpich, Germany; Wilfried Piefenbrink, Erkelenz, Germany; Werner Hensgens, Geilenkirchen, Germany

[73] Assignees: HDRK Mining Research Limited, Sasakatoon, Canada; WIRTH Maschinen-und Bohrgeräte-Fabrik GmbH, Erkelenz, Germany

[21] Appl. No.: 08/849,876

[22] PCT Filed: Dec. 13, 1995

[86] PCT No.: PCT/CA95/00695

§ 371 Date: Sep. 5, 1997

§ 102(e) Date: Sep. 5, 1997

[87] PCT Pub. No.: WO96/19639

PCT Pub. Date: Jun. 27, 1996

[30] Foreign Application Priority Data

Dec. 19, 1994 [CA] Canada ..... 2138461

[51] Int. Cl.[6] ..... E21D 9/10; E21C 35/24

[52] U.S. Cl. ..... 299/1.4; 299/1.8; 299/61

[58] Field of Search ..... 299/1.05, 1.3, 299/1.4, 1.8, 30, 61, 80.1

[56] References Cited

U.S. PATENT DOCUMENTS

| | | | |
|---|---|---|---|
| 4,033,626 | 7/1977 | Dinkelbach | 299/1.8 |
| 4,248,481 | 2/1981 | Stoltefuss | 299/33 |
| 4,343,512 | 8/1982 | Heitkamp et al. | 299/1.3 |

FOREIGN PATENT DOCUMENTS

91/18185 11/1991 WIPO .

*Primary Examiner*—David J. Bagnell

*Attorney, Agent, or Firm*—Ware, Fressola, Van Der Sluys & Adolphson LLP

[57] ABSTRACT

An automatic control of the operation of a machine used for excavating drifts, tunnels, stopes, caverns or the like of a predetermined profile having a rotatable head (10) and cutting arms (14, 16) mounted on the head for rotation therewith, extending in the direction of excavation with at least one cutting arm (14, 16) being radially pivotable. The angular position (ϕ) of the head (10) is continuously measured and the output signals from these measurements are processed by the computer (44) which controls the angular positions of the head and of the arms according to a predetermined profile code or program stored in the computer memory for cutting the predetermined profile. Additional sensors (54,56) may be provided to control other parameters such as RPM of the rotating head, the force exerted on the arms, the positioning of the machine and the like.

27 Claims, 7 Drawing Sheets

AUTOMATIC CONTROL SYSTEM AND METHOD FOR A MACHINE USED FOR EXCAVATING DRIFTS, TUNNELS, STOPES, OR CAVERNS

TECHNICAL FIELD

This invention relates to a system and a method for automatically controlling the operation of a machine used for excavating drifts, tunnels, stopes, caverns or the like of a predetermined profile. More particularly, the invention relates to automatic control of machines having a rotatable head on which are mounted at least two cutting arms which are rotatable with the head and extend in the direction of excavation and at least one of these tool arms is radially pivotable by means of a hydraulic cylinder.

BACKGROUND OF THE INVENTION

A number of excavation machines are known for cutting drifts, tunnels, stopes, caverns or the like, which have a rotatable head on which a plurality of arms are mounted that extend in the direction of excavation and which are radially pivotable by means of hydraulic cylinders to achieve a desired excavation profile. One example of such a machine is disclosed in European Patent No. 0551273 which belongs to the same applicants as the present application. Another example is disclosed in German Offenlegungsschrift DE 31 40 707 and still a further example is given in U.S. Pat. No. 4,248,481. Most of these prior art references indicate that the machines in question can be used to cut various profiles, however, the actual cutting of such profiles must be done by the operator of the machine who, for example, must adjust the extension of the arms to cut corners in a rectangular profile or to cut uneven angles in profiles where such angles are desired. This leads to considerable difficulties and results in uneven excavations. Also the achieved results greatly depend on the expertise of the operator of the machine which in itself leads to a great deal of inconsistency.

It is suggested in European Patent No. 0551273 that the pivot drives for the tool arms can be controlled automatically using a computer program, however, no parameters on which such a program would be based have been defined. A general computer program could be used, but it would be difficult to adapt it to various rock conditions and various profiles that one may need to cut during the excavation.

SUMMARY OF THE INVENTION

An object of the present invention is, therefore, to provide a novel automatic control method and system for such excavation machines, particularly to achieve automatically any desired profile during excavation.

Another object of the invention is to optimize the automatic control of the excavation in relation to the various conditions that may exist during the excavation.

Other objects and advantages of the invention will become apparent from the following description thereof.

The basic method of the present invention involves automatically controlling the operation of a machine used for excavating drifts, tunnels, stopes, caverns or the like of a predetermined profile, such machine having a rotatable head on which are mounted at least two cutting arms which are rotatable with the head and extend in the direction of excavation, at least one of these cutting arms being radially pivotable, the novel method comprising the steps of: continuously measuring angular position $\phi$ of the head as it is rotating; continuously measuring radial position angle $\theta$ of each pivotable cutting arm; processing output signals from the measurements of $\phi$ and $\theta$ and controlling the machine so that for each angular position $\phi$ of the head, each pivotable tool arm is radially positioned at a preset angle $\theta$ according to a predetermined profile code.

The fundamental system of the present invention for automatically controlling the operation of a machine used for excavating drifts, tunnels, stopes, caverns or the like of a predetermined profile, relates to a machine having a rotatable head on which are mounted at least two cutting arms which are rotatable with the head and extend in the direction of excavation, at least one of these cutting arms being radially pivotable by means of a hydraulic cylinder having a piston and a shaft one end of which is connected to the piston and the other acts on each pivotable cutting arm to pivot the same, the system comprising: means for continuously measuring the angular position $\phi$ of the head as it is rotating; means for continuously measuring the radial position angle $\theta$ of each pivotable cutting arm; a computer responsive to output signals of said means for measuring $\phi$ and $\theta$, which computer controls valve means which continuously control flow of hydraulic fluid to the hydraulic cylinder so that for each angular position $\phi$ of the head, each pivotable cutting arm is radially positioned at a preset angle $\theta$ according to a predetermined profile code stored in the computer memory for cutting the predetermined profile.

The means for measuring $\phi$ and $\theta$ normally comprise angular encoders which are known in the art. For example, a 16 bit absolute optical encoder can be used. Two operations are done to read the angle. To avoid information changes between the two operations, the data latch signal of the encoder is employed with a suitable optical isolator. A reading is taken by each encoder every millisecond or so, constituting an essentially continuous operation. The signals from the encoders are continuously transmitted to the computer. If the encoder has a digital output, then such signals can be processed directly, otherwise they may go through an A/D (ANALOG to DIGITAL) converter. This is well known in the art. The computer has a microprocessor or other signal processing means whereby it computes the instantaneous angular position $\phi$ of the head as it rotates and the instantaneous radial position $\theta$ of each radially tiltable arm during such rotation. The computer also comprises a controller that correlates these positions to achieve a desired profile; a Parker controller, for example, can be used for this purpose.

Thus, when a square or rectangular profile is desired, the predetermined code or program, which may consist of suitable position tables that are held in the computer memory for each predetermined profile, will be used to control the flow of hydraulic fluid into the hydraulic cylinder in such a manner as to extend the tool arms as they reach the corners and suitably retract them when they have passed the corner position. This is done, for example, through a proportional valve which allows a continuous flow of hydraulic fluid into the hydraulic cylinder, on either side of the piston. In this manner the corners in the desired profile can be automatically cut. If there are a plurality of cutting arms for cutting the outer portion of the profile, for instance three such arms, then it is preferable to control the position of each arm individually in the above described manner, thereby avoiding any possibility of collision between the arms.

In addition, in order to optimize the cutting of a predetermined profile, several other operations and parameters may be controlled. Thus, the rotatable head is rotated by a suitable drive and the invention may further comprise the steps of sensing drive RPM (revolutions per minute) and processing resulting RPM signals to control the speed of rotation of the head during the excavation. This is done by using RPM sensing means or RPM sensors such as tachometers on the drive with the computer being responsive to output signals from such RPM sensors to achieve the desired control. Thus, the RPM of the cutting head can be adjusted to revolve more slowly during the cutting of the corners than while cutting the rest of the profile, thereby limiting tool surface velocity and optimizing torque/horsepower control and production.

Furthermore, load sensing means, such as strain gauges, may be provided on each pivotable cutting arm to measure the force opposing penetration of the cutting tool on each arm into the rock to be cut.

The pressure differential in the hydraulic cylinders is also measured by sensing the hydraulic pressure on each side of the piston in each cylinder. The computer is responsive to output signals from the load sensing means and the pressure sensing means to enhance control of the valve means which continuously control the flow of hydraulic fluid to each side of the piston so as to maintain said pressures and the pressure differential within predetermined values suitable to apply sufficient force onto the pivotable tool arms for proper penetration of the cutting tools to cut the predetermined profile. The strain gauges are preferably used so as to permit measurement of forces exerted on each pivotable arm in all three directions, namely x, y and z directions.

The cutting tool penetration control is, first of all, a function of the incremental, indexed radial position of the cutting tool and can be expressed as follows:

$$R_{Ti}\{\phi,\theta(T_{i-1})\}$$

where:

$R_{Ti}$ is the radial position at time $T_i$;

$\phi$ is the cutting head angle from the previous cut; and $\theta(T_{i-1})$ is the pivotable arm's radial angle from the previous cut.

Then, when force measurements are introduced, the formula becomes:

$$R_{Ti}\{\phi,\theta(T_{i-1})F\}$$

where, in addition, F is the opposing force from the load measurement on each pivotable arm.

In this manner we can control the load by distributing it in a desired manner between all pivotable arms.

When cutting tools on the cutting arms consist of rotatable discs, the invention may further provide for RPM sensors for such discs and the computer being responsive to output signals from the disc RPM sensors from which it computes the disc diameter and consequently disc wear and corrects the radial position angle $\theta$ of each pivotable cutting arm in relation thereto.

In addition, there may be provided machine position sensing means which continuously detect the spatial coordinates of the machine with the computer also being responsive to output signals from such sensing means to correct any errors in angular position resulting from a shift of the machine and/or to control the direction of excavation. Such machine position sensing means may, for example, comprise spatial targets at the front of the machine and a laser source directing at least one laser beam to detect the spatial coordinates of the machine. Moreover, there may be provided machine roll sensing means, such as an inclinometer, to continuously measure the roll of the machine and the output signals therefrom are processed by the computer to correct any errors in the radial positioning angle $\theta$ of each pivotable arm resulting from a variation of the machine roll.

Also, the machine will normally comprise means for moving the rotatable head in horizontal direction, which is usually a hydraulic cylinder. The invention may provide means for sensing the position of the head as it is advanced or retracted in the horizontal direction, such as a linear encoder, and the resulting signals are processed by the computer to adjust the horizontal position of the head so as to exert adequate force on the arms for cutting of the predetermined profile in various rock formations. This also achieves better control of the cutting tool penetration into rock and control of the profile during turns.

The computer used for processing the various signals may be of any suitable type. However, it was found useful to have a microprocessor for each pivotable arm with a controller to continuously control the position of each arm individually by controlling the valves that control the flow of hydraulic fluid into the hydraulic cylinders acting on the arms. All such microprocessors may be connected to a PLC (programable logic controller) which may be used for controlling operations of the machine other than arm positioning. The PLC is normally provided with an operator interface allowing operator input. It should be pointed out that the type and arrangement of a suitable computer greatly depends on the type of the machine being controlled, the number of cutting arms on such machine and the number of parameters which one desires to control.

A machine for excavating drifts, tunnels, stopes, caverns or the like, having an automatic control system described herein is also included within the scope of the present invention.

BRIEF DESCRIPTION OF THE DRAWINGS

The invention will now be described with reference to the appended drawings in which.

DETAILED DESCRIPTION OF THE INVENTION

Figure 1:
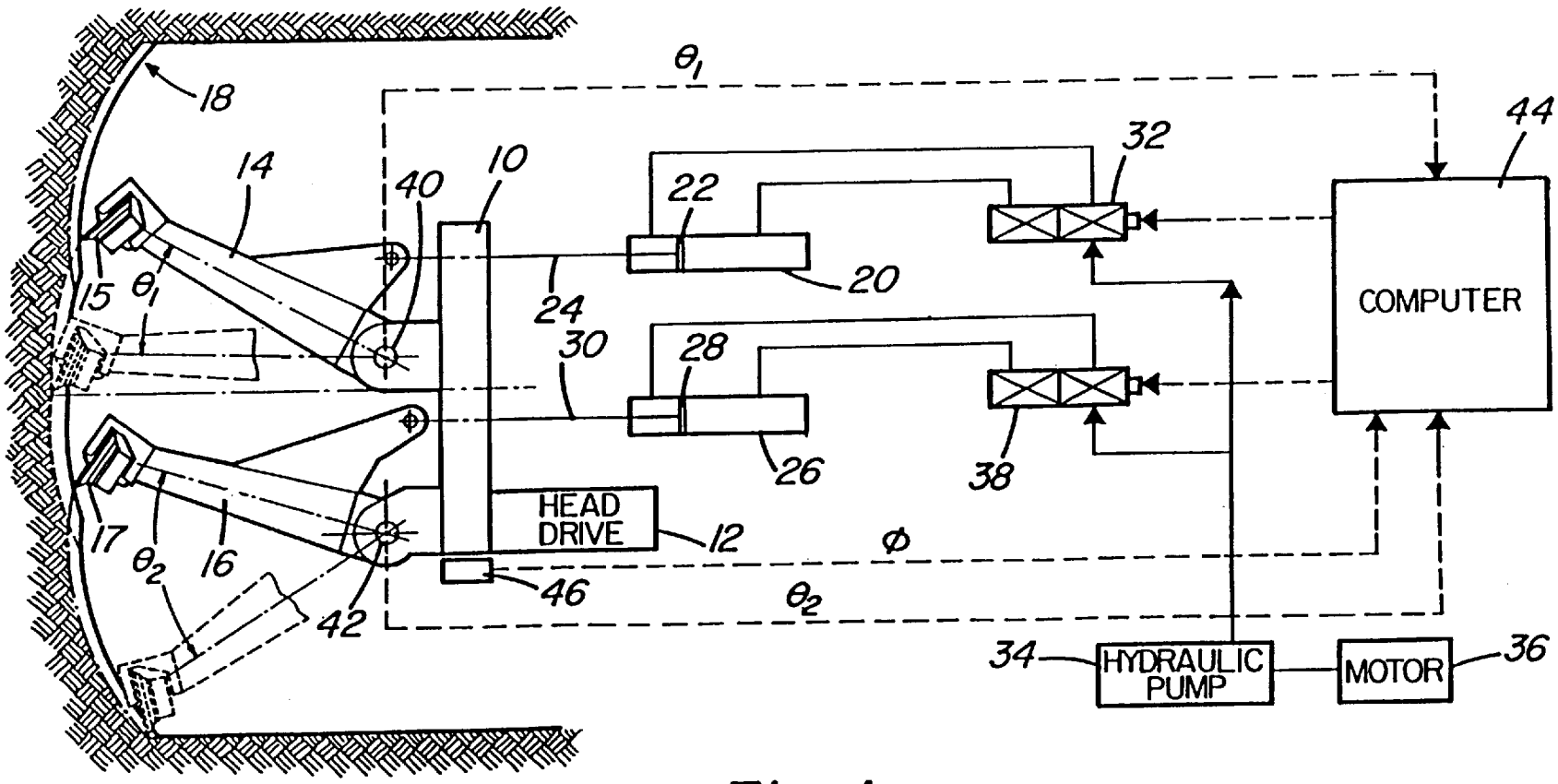
FIG. 1 is a diagrammatic illustration showing the basic control arrangement in accordance with this invention.

Referring to FIG. 1, it shows a rotatable head 10 of the machine driven by head drive 12, on which are mounted two radially pivotable cutting arms 14 and 16 with cutting disc tools 15, 17 at their ends. It should be mentioned that this invention does not relate to single arm machines, such as disclosed, for example, in U.S. Pat. No. 5,205,612, which are based on a totally different concept. The invention relates to machines having a plurality of cutting arms, namely at least two arms, extending in the direction of excavation, of which at least one is radially pivotable. In FIG. 1, arm 14 is used to cut the central part of the tunnel 18 and arm 16 the outer profile of such tunnel. Arm 14 is pivotable by means of hydraulic cylinder 20 which has a piston 22 and a shaft 24 one end of which is connected to the piston 22 and the other acts on arm 14 so that when shaft 24 extends out of the cylinder, arm 14 is radially pivoted toward the centre of the excavation a certain desired distance defined, for example, by angle $\theta_1$. Similarly, arm 16 is pivoted by means of hydraulic cylinder 26 which has a piston 28 and a shaft 30 one end of which is connected to piston 28 and the other acts on arm 16 so that when shaft 30 extends out of the cylinder, arm 16 is radially pivoted towards the outer walls of the excavation a certain desired distance defined, for example, by angle $\theta_2$. The pivoting of arm 14 is controlled by controlling the flow of fluid on each side of piston 22 through valve means 32 through which hydraulic fluid flows to either end of cylinder 20 supplied by hydraulic pump 34 actuated by motor 36. Also the pivoting of arm 16 is similarly controlled by controlling the flow of fluid on each side of piston 28 through valve means 38 through which hydraulic fluid flows to either end of cylinder 26 also supplied by hydraulic pump 34 driven by motor 36.

The valve means 32, 38 may consist of servo valves which allow continuous and regulated flow of hydraulic liquid into either end of the cylinder.

According to the present invention, pivotable arms 14, 16 are provided with means for continuously measuring the radial position angle $\theta$, i.e. $\theta_1$ and $\theta_2$, such as angular encoders 40, 42 placed at the pivot points of arm 14, 16, which then transmit output signals of $\theta_1$ and $\theta_2$ to computer 44. The measurement of angles $\theta_1$ and $\theta_2$ can be made from any initial predetermined position of arms 14, 16 or with relation to a predetermined line such as horizontal or vertical or the like. This, of course, will be reflected in the computer tables or algorithm controlling the positions of these angles. Furthermore, according to this invention the position angle $\phi$ of the head 10 is also continuously measured, for instance, by angular encoder 46 and the output of this measurement is also continuously transmitted to the computer 44.

Figure 2:
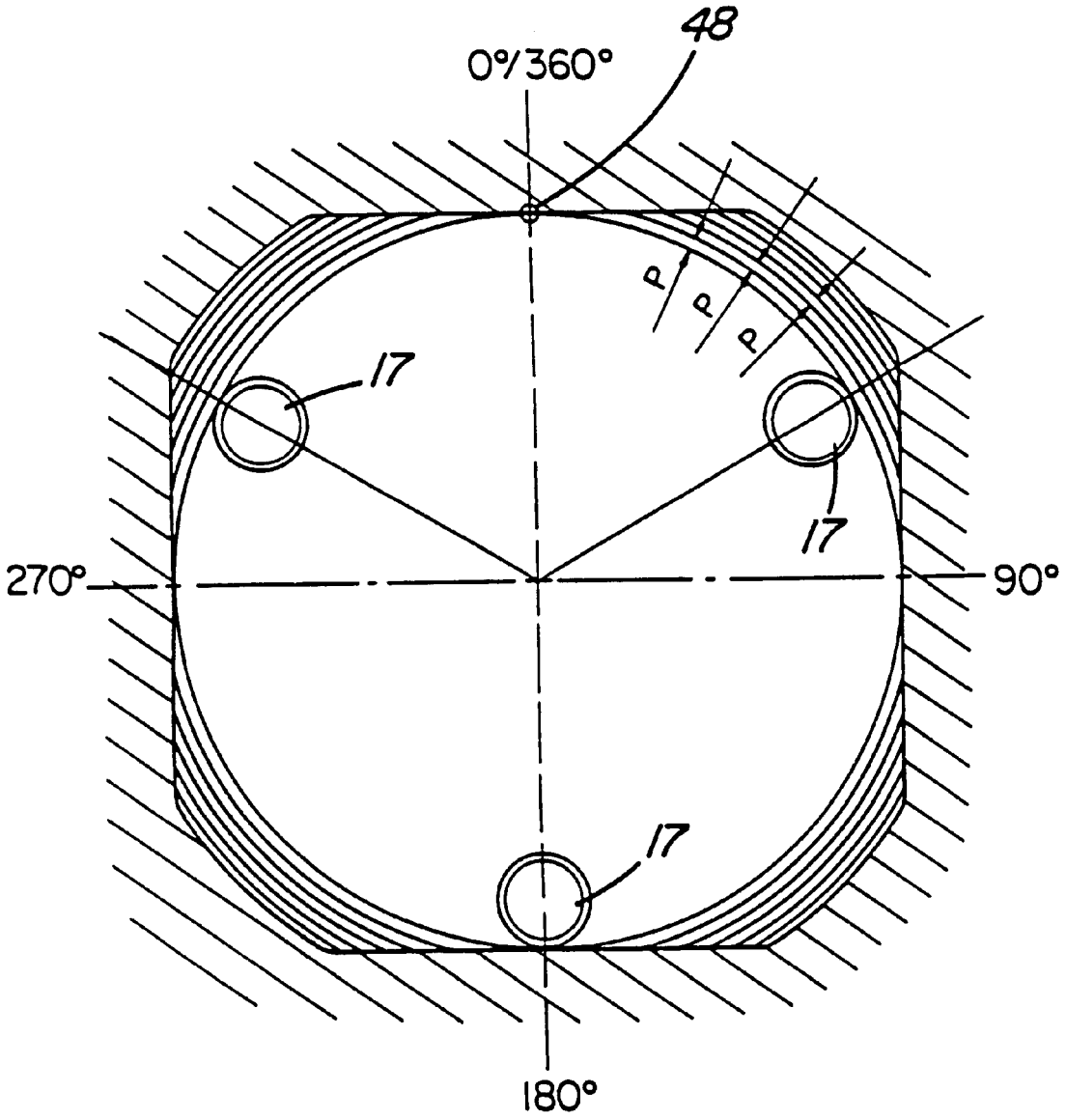
FIG. 2 illustrates the angular positioning of a cutting arm when cutting a particular profile in accordance with this invention.

Here again angle $\phi$ may be measured with reference to any predetermined line, but usually it will be with reference to the vertical axis where the upper point 48 will normally serve as 0° and 360°, as shown in FIG. 2. The computer 44 will process the output signals from angular encoders 40, 42 and 46 so that for each angle $\phi$ a corresponding predetermined angle $\theta_1$ and $\theta_2$ is provided and will control valves 32 and 38 accordingly. This control operation is normally performed by the computer every millisecond according to a suitable algorithm or predetermined profile code tables stored in the computer memory. Referring again to FIG. 2, if it is desired to cut the profile shown therein, the disc cutter 17 rotating, for example, in the clockwise direction will need to be extended further when head 10 rotates at $\theta_2$ angles in the corners, e.g. between 15°–75°, 105°–165°, 195°–255° and 285°–345°, than between the corners at angles 0°, 90°, 180° or 360°. This is done by controlling angular position $\theta_2$ of arm 16 so that in the corners the arm extends further as the head rotates to achieve additional penetration P to cut such corners according to the predetermined profile. As tool 17 moves out of the corner area, $\theta_2$ will be adjusted so that arm 16 will retract sufficiently not to affect the lateral walls and the ceiling of the tunnel being cut.

Figure 3:
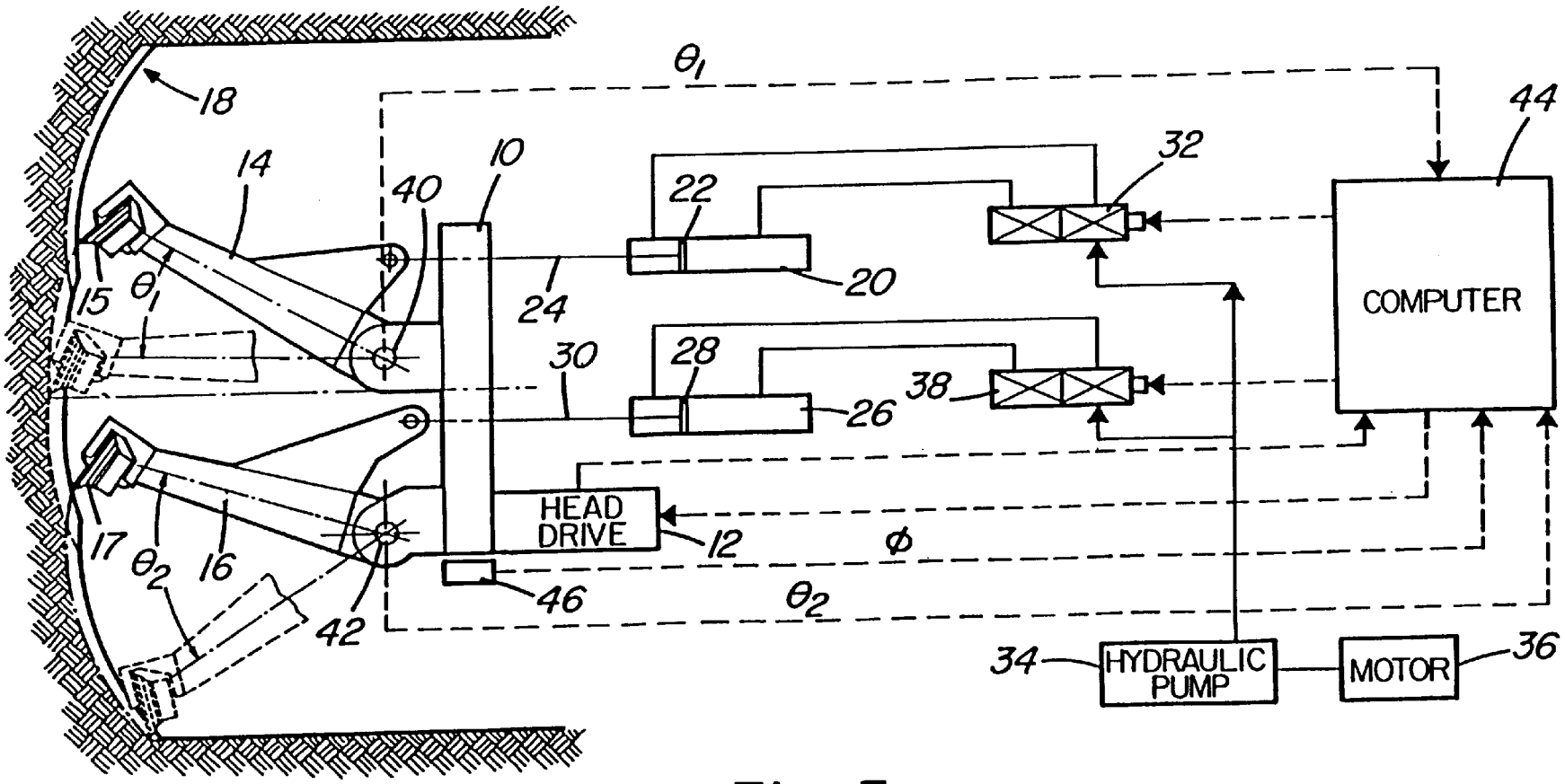
FIG. 3 is another diagrammatic illustration of the novel control system where the control of the machine head RPM is included.

Referring to FIG. 3 where the same features are designated by the same reference number as in FIG. 1, and this applies to all figures, the RPM provided by head drive 12 is also continuously measured using a suitable instrument, such as a tachometer, and the output signals are processed by computer 44 so as to adjust the RPM of the head 10 as may be required. Usually the head will rotate anywhere between 3 RPM and 21 RPM, however, to optimize the cutting of a given profile, it may be suitable to reduce the RPM in the corners. This RPM control also optimizes torque/horsepower control as well as overall production.

Figure 4:
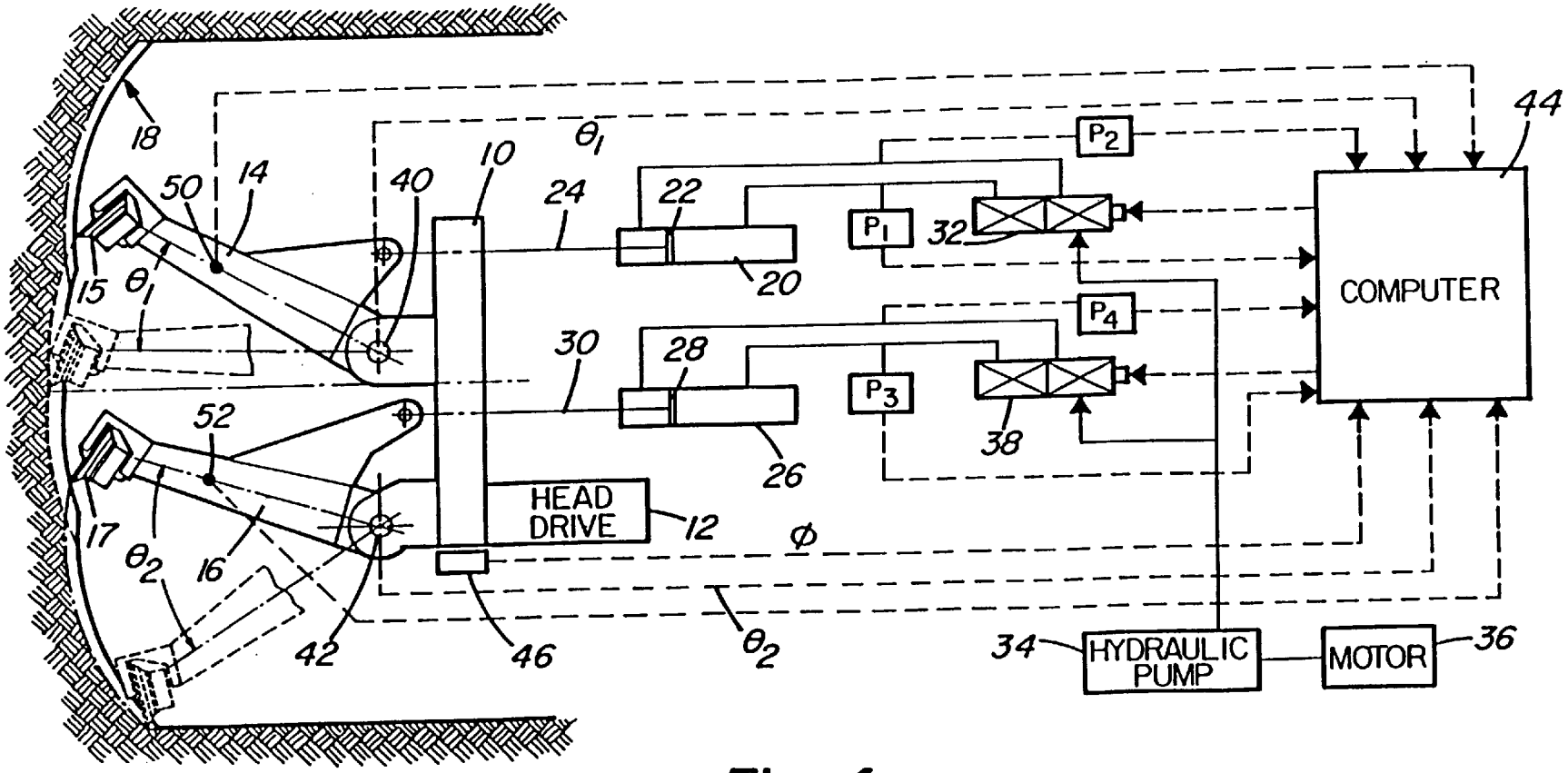
FIG. 4 is a further diagrammatic illustration of the novel control system, including control of the force exerted on the cutting arms.

With reference to FIG. 4, it illustrates a embodiment of the present invention where load sensing means, such as strain gauges 50 and 52 are provided on arms 14 and 16 respectively. These strain gauges may be such as to measure the load or force exerted on the arms 14, 16 from all three directions x, y, z. Also in cylinders 20 and 26, pressure gauges are provided to measure pressures $P_1$, $P_2$ and $P_3$, $P_4$ respectively on each side of pistons 22 and 28. The output signals from the strain gauges 50 and 52 and from the pressure gauges $P_1$, $P_2$ and $P_3$, $P_4$ are processed by the computer 44 to provide proper adjustments to the force applied by the arms 14, 16 to achieve suitable penetration of the rock being cut. Thus, more force may be applied in the corners of the predetermined profile or if the rock is harder than usual or the like.

Figure 5:
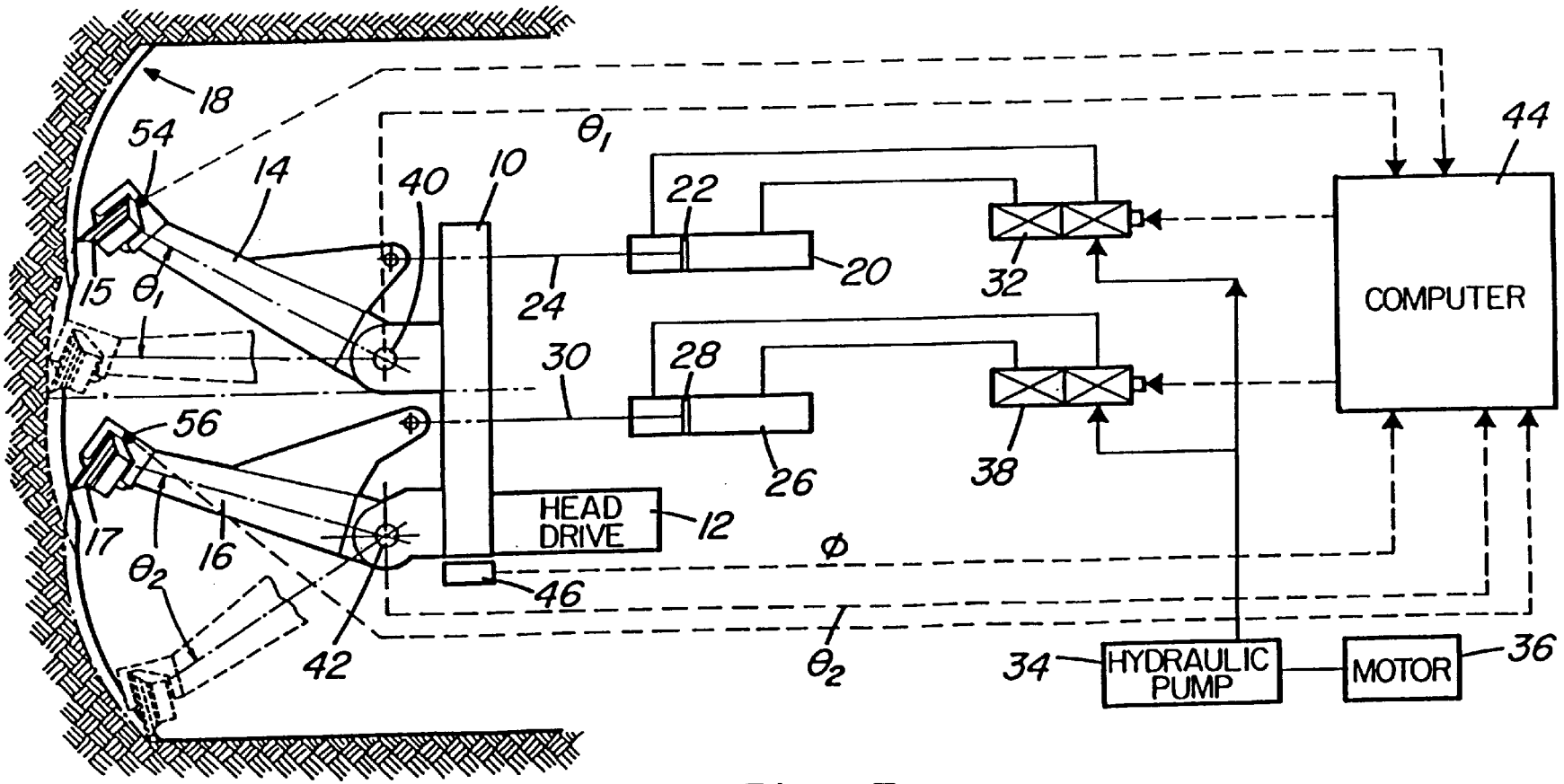
FIG. 5 is a still further diagrammatic illustration of the novel control system, including RPM sensors for the cutting discs.

As shown in FIG. 5, cutting discs 15 and 17 may be provided with RPM sensors 54 and 56 to measure the RPM of these discs. The signals from such measurements are processed by the computer 44 to compute the disc diameter and consequently determine disc wear and then to correct the radial position angles $\theta_1$ and $\theta_2$ of arms 14 and 16 accordingly. It should be pointed out, in this regard, that the tools of various pivotable arms may wear out at a different rate and to achieve a satisfactory cut of the profile it may be appropriate to take into account this wear and to adjust the position of the tools accordingly. This is achieved herein by measuring the RPM of the cutting discs and provision of an algorithm in the computer which, through its controller, then sends appropriate commands for controlling valves 32 and 38 respectively.

Figure 6:
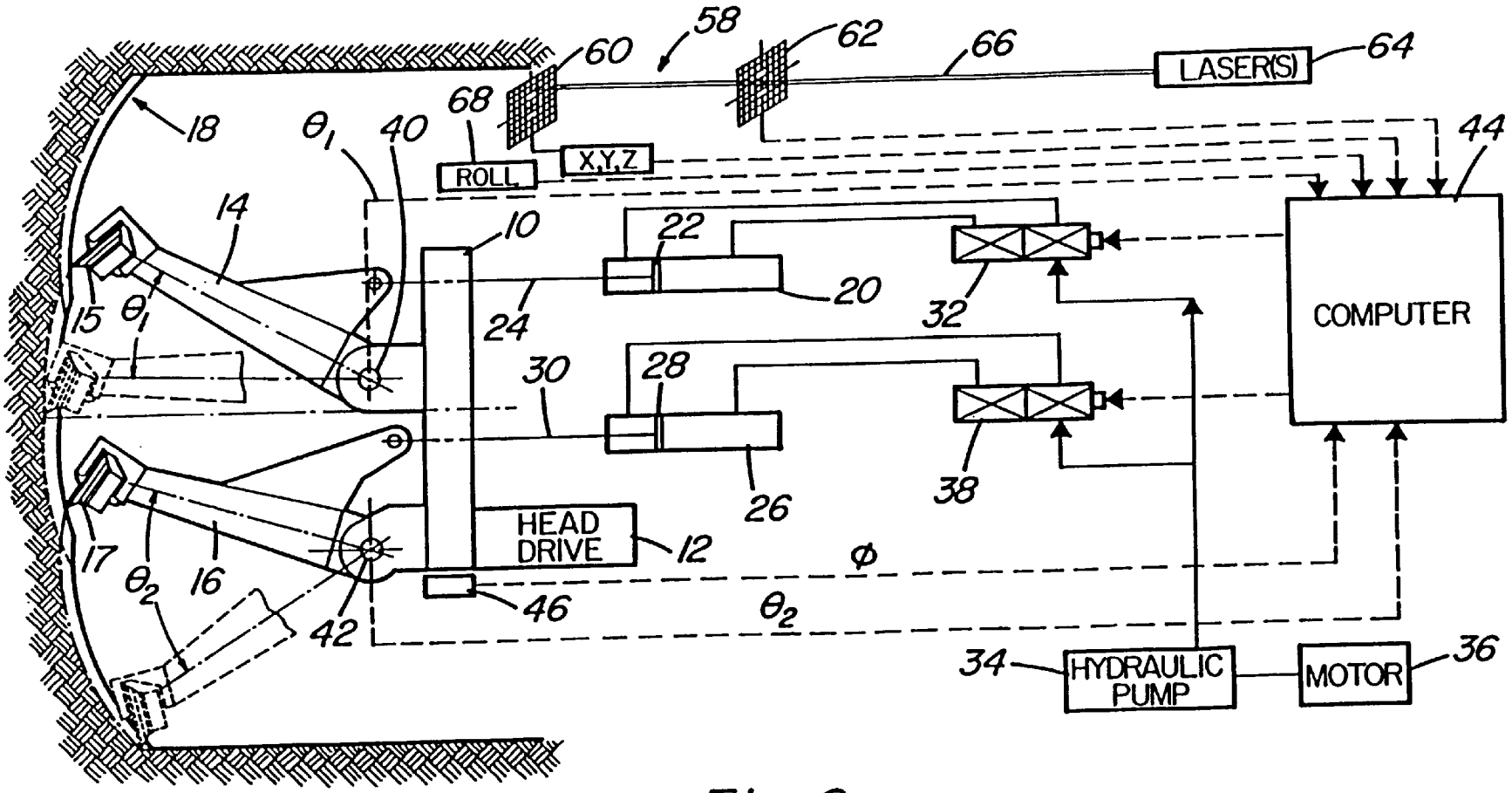
FIG. 6 is a still further diagrammatic illustration of the novel control system, including control related to the position of the machine and/or the roll of the machine.

Referring to FIG. 6, there may also be provided machine position sensing means 58. There are various position sensing means available, such as laser, sonar/ultrasonic and electrical/electronic, however, in this example, spatial targets 60, 62 are provided at the front of the machine and a source of laser 64 at the back directing at least one laser beam 66 onto the targets 60, 62 to determine the spatial coordinates x, y, z of the machine. The output signals from these measurements are processed by the computer 44 so as to correct, through valves 32, 38, the angles $\theta_1$ and $\theta_2$ due to any shift of the machine. This may also be used to control the direction of excavation as required, according to a predetermined computer code. Moreover, machine roll sensing means 68, such as an inclinometer, may be provided to measure the roll of the machine (its inclination with reference to the horizontal) and again the output signals therefrom are processed by the computer 44 to correct any errors in the radial position angles $\theta_1$ and $\theta_2$ resulting from the variation of a machine roll.

Figure 7:
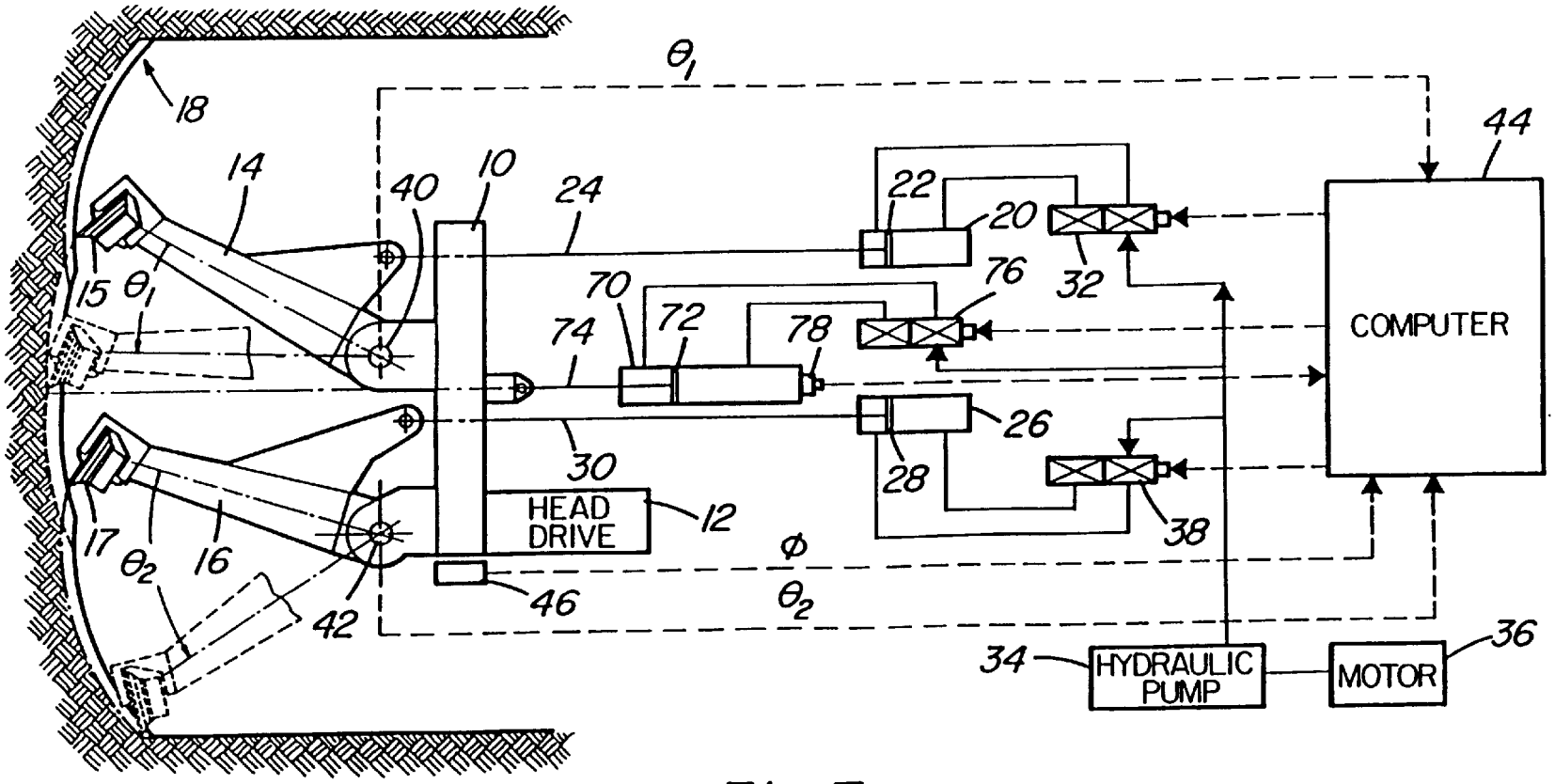
FIG. 7 is a still further diagrammatic illustration of the novel control system, including the control of the horizontal position of the head.

Finally, FIG. 7 illustrates a further embodiment of the invention wherein the machine is provided with means for moving the rotatable head 10 in the horizontal direction while the machine itself remains stationary. This could be done by various means such as a hydraulic cylinder arrangement or by hydraulic-mechanical drives or by a rack and pinion gearing mechanism or the like. In the present case, there is illustrated in FIG. 7 a hydraulic cylinder which has a piston 72 and a shaft 74 extending from said piston and acting on the head 10 to push it forward or to retract it as may be necessary; this is done through valve 76 which allows the hydraulic fluid to flow on either side of piston 72 in the cylinder 70. The hydraulic fluid can again be supplied by hydraulic pump 34 driven by motor 36. Usually there is provided in various excavating machines means for advancing or retracting the head by about one meter without moving the machine itself. The head can thus be pushed to exert suitable force on cutting arms 14, 16 thus enabling to control cutting depth as well as permitting to cut turns and the like.

According to the present invention, there are provided extension sensing means 78, such as a linear encoder, which continuously measure the extension of the shaft 74 within the cylinder or out of the cylinder and thus the horizontal position of head 10, and the computer 44 processes signals from such measurements and controls valve 76 to adjust said position as may be required depending on the circumstances of excavation, to cut the predetermined profile.

It should be mentioned that the various parameters illustrated in FIG. 3 to FIG. 7 can be used singly with the basic control shown in FIG. 1 or in any combination with one another and with said basic control. The computer 44 can be a single computer, if it has sufficient processing power, or it can consist of a plurality of microprocessors or computers operating in combination with one another. For example, there may be provided a separate microprocessor for each pivotable arm with a controller to continuously control the position of each arm individually by controlling the flow of hydraulic fluid into the hydraulic cylinders acting on the arms and these microprocessors may be connected to a PLC that can be used for controlling the other operations of the machine such as described above and provided with an operator interface allowing operator input.

In order to operate the machine with automatic controls pursuant to the present invention, the operator may proceed as follows:

1. Position the machine at the face to be cut, for example, using laser target positioning, and fix the machine with grippers in such position;
2. Input the profile that is desired to be cut, choosing the depth of cut, the penetration, the RPM and other desired parameters within the computer code or program;
3. Push the start button to start the automatic cutting of the profile predetermined in 2 above;
4. The automatic cutting proceeds until the head is fully advanced (about one meter) thus ending the cycle;
5. At the end of such cycle, the arms are retracted to a safe position, the head is fully retracted, the machine is ungripped and advanced to a new position using laser target positioning and the cycle may be repeated as often as required to achieve the desired excavation.

The invention has been described with reference to its preferred embodiments, but obvious modifications can be made therein by those skilled in the art without departing from the spirit of the invention and the scope of the following claims.

We claim:

1. A system for automatically controlling the operation of a machine used for excavating drifts, tunnels, stopes, or caverns of a predetermined profile, said machine having a rotatable head on which are mounted at least two cutting arms which are rotatable with the head and extend in the direction of excavation, at least one of said cutting arms being radially pivotable by means of a hydraulic cylinder having a piston and a shaft one end of which is connected to the piston and the other acts on each pivotable cutting arm to pivot the same, said system comprising:

means for continuously measuring angular position $\phi$ of the head as it is rotating;

means for continuously measuring radial position angle $\theta$ of each pivotable cutting arm;

a computer responsive to output signals of said means for measuring $\phi$ and $\theta$, said computer controlling valve means which continuously control flow of hydraulic fluid to the hydraulic cylinder so that for each angular position $\phi$ of the head, each pivotable cutting arm is radially positioned at a preset angle $\theta$ according to a predetermined profile code stored in the computer memory for cutting said predetermined profile.

2. A system according to claim 1, in which said means for measuring $\phi$ and $\theta$ comprise an angular encoder.

3. A system according to claim 2, in which the angular encoder is an optical encoder.

4. A system according to claim 1, in which said valve means comprise a proportional valve which allows a continuous flow of hydraulic fluid into the hydraulic cylinder, on either side of the piston.

5. A system according to claim 1, wherein the rotatable head is rotated by a suitable drive, said system further comprising RPM sensing means on said drive, and the computer also being responsive to output signals from said drive RPM sensing means to control speed of rotation of the head during the excavation so as to optimize cutting of the predetermined profile.

6. A system according to claim 1, further comprising load sensing means on each pivotable cutting arm and pressure sensing means for sensing hydraulic pressure on each side of the piston of the hydraulic cylinder connected to each said pivotable cutting arm, and the computer also being responsive to output signals from said load sensing means to enhance control of the valve means which continuously control the flow of hydraulic fluid to each side of the piston to maintain said pressures within predetermined values suitable to apply sufficient force onto the pivotable cutting arms for cutting of the predetermined profile.

7. A system according to claim 6, wherein the load sensing means comprise strain gauges suitable for sensing forces exerted on each pivotable cutting arm in x, y and z directions.

8. A system according to claim 1, in which cutting tools on the pivotable cutting arms consist of rotatable discs, said system further comprising RPM sensors for said discs, and the computer also being responsive to output signals from said disc RPM sensors from which it computes the disc diameter and consequently disc wear and corrects the radial position angle $\theta$ of each pivotable cutting arm in relation thereto.

9. A system according to claim 1, further comprising machine position sensing means which continuously detect spatial coordinates of the machine, the computer also being responsive to output signals from said machine position sensing means to correct any errors in the radial position angle $\theta$ of each pivotable cutting arm resulting from a shift of the machine and/or to control direction of excavation.

10. A system according to claim 9, in which the machine position sensing means comprise spatial targets at the front of the machine and a source of laser directing at least one laser beam onto said targets to detect the spatial coordinates of the machine.

11. A system according to claim 1, further comprising machine roll sensing means, and the computer also being responsive to output signals from said roll sensing means to correct any errors in the radial position angle θ of each pivotable cutting arm resulting from a variation of the machine roll.

12. A system according to claim 11, in which the roll sensing means comprise an inclinometer.

13. A system according to claim 1, wherein the machine comprises means for moving the rotatable head in horizontal direction and means for sensing the position of the head as it is advanced or retracted in the horizontal direction, and the computer also being responsive to output signals from said position sensing means to adjust the horizontal position of the head so as to exert adequate force on the cutting arms for cutting of the predetermined profile.

14. A system according to claim 13, wherein the machine comprises a hydraulic cylinder for moving the rotatable head in the horizontal direction, said hydraulic cylinder having a piston and a shaft extending from the piston to act on the head so as to advance or retract the same, said system comprising extension sensing means for sensing the extension of said shaft, and the computer also being responsive to output signals from said extension sensing means to adjust the horizontal position of the head so as to exert adequate force on the cutting arms for cutting of the predetermined profile.

15. A system according to claim 14, wherein the extension sensing means comprise a linear encoder.

16. A system according to claim 1, wherein the computer comprises a microprocessor for each pivotable cutting arm with a controller to continuously control the position of each said arm individually by controlling the valves which control the flow of hydraulic fluid into the hydraulic cylinders acting on the said arms.

17. A system according to claim 16, wherein all microprocessors are connected to a programmable logic controller used for controlling operations of the machine other than cutting arm positioning and provided with an operator interface allowing operator input.

18. A machine for excavating drifts, tunnels, stopes, caverns or the like, having an automatic control system according to any one of claims 1 to 17.

19. A method for automatically controlling the operation of a machine used for excavating drifts, tunnels, stopes, or caverns of a predetermined profile, said machine having a rotatable head on which at least two cutting arms are mounted which are rotatable with the head and extend in the direction of excavation, at least one of said cutting arm being radially pivotable, said method comprising the steps of:

continuously measuring angular position ϕ of the head as it is rotating;

continuously measuring radial position angle θ of each pivotable cutting arm;

processing output signals from the measurements of ϕ and θ, and controlling the machine so that for each angular position ϕ of the head, each pivotable cutting arm is radially positioned at a preset angle θ according to a predetermined profile code.

20. A method according to claims 19, wherein the rotatable head is rotated by a suitable drive, said method further comprising the steps of sensing drive RPM and processing resulting RPM signals to control speed of rotation of the head during the excavation so as to optimize cutting of the predetermined profile.

21. A method according to claim 19, further comprising the steps of sensing the load applied to each pivotable cutting arm during excavation and processing resulting signals to maintain said load within predetermined values suitable to apply sufficient force onto the arms for cutting of the predetermined profile.

22. A method according to claim 21, wherein the step of sensing the load comprises measurement of forces exerted on each pivotable cutting arm in x, y and z directions.

23. A method according to claim 19, wherein cutting tools on the pivotable cutting arms consist of rotatable discs, said method further comprising the steps of sensing RPM of said discs and processing resulting output signals to compute the disc diameter and consequently disc wear and correct the radial position angle θ of each pivotable cutting arm in relation thereto.

24. A method according to claim 19, further comprising the steps of sensing the machine position to determine spatial coordinates of the machine and processing resulting output signals to correct any errors in radial position angle θ of each pivotable cutting arm resulting from any shift of the machine and/or to control direction of excavation.

25. A method according to claim 19, further comprising the steps of sensing roll of the machine and processing resulting output signals to correct any errors in the radial positioning angle θ of each pivotable tool arm resulting from a variation of the machine roll.

26. A method according to claim 19, wherein the machine comprises means for moving the rotatable head in the horizontal direction, said method further comprising the steps of sensing the position of the head as it is advanced or retracted in the horizontal direction and processing the resulting output signals to adjust said position so as to exert adequate force on the arms for cutting of the predetermined profile.

27. A method according to claim 26 wherein the machine comprises a hydraulic cylinder for moving the rotatable head in the horizontal direction, said method comprising sensing the extension of the hydraulic cylinder and processing resulting output signals to adjust the horizontal position of the head so as to exert adequate force on the arms for cutting of the predetermined profile.

* * * * *

UNITED STATES PATENT AND TRADEMARK OFFICE

CERTIFICATE OF CORRECTION

PATENT NO : 5,938,288

DATED : August 17, 1999

INVENTOR(S): Saint-Pierre et al.

It is certified that error appears in the above-identified patent and that said Letters Patent is hereby corrected as shown below:

On the title page: Item [75]

"Jeffrey Nicholas Repski, Saskatoon" should read --Jeffrey Nicholas Repski, Dowling--.

Item [73]

"Sasakatoon, Canada" should read --Saskatoon, Canada--.

Signed and Sealed this

Twentieth Day of June, 2000

*Attest:*

Q. TODD DICKINSON

*Attesting Officer*

*Director of Patents and Trademarks*